US011890528B1

(12) United States Patent
Doerksen et al.

(10) Patent No.: US 11,890,528 B1
(45) Date of Patent: Feb. 6, 2024

(54) CONCAVE SIDE RAILS FOR ONE-WHEELED VEHICLES

(71) Applicant: Future Motion, Inc., Santa Cruz, CA (US)

(72) Inventors: Kyle Jonathan Doerksen, Santa Cruz, CA (US); Maximilian Fredrick Ballenger Sluiter, Oak Park, CA (US)

(73) Assignee: FUTURE MOTION, INC., Santa Cruz, CA (US)

( * ) Notice: Subject to any disclaimer, the term of this patent is extended or adjusted under 35 U.S.C. 154(b) by 0 days.

(21) Appl. No.: 18/056,588

(22) Filed: Nov. 17, 2022

(51) Int. Cl.

| | |
|---|---|
| ***A63C 17/12*** | (2006.01) |
| ***A63C 17/00*** | (2006.01) |
| ***A63C 17/08*** | (2006.01) |

(52) U.S. Cl.
CPC ..... *A63C 17/0046* (2013.01); *A63C 17/08* (2013.01); *A63C 17/12* (2013.01); *A63C 2203/12* (2013.01); *A63C 2203/20* (2013.01)

(58) Field of Classification Search
CPC ..... A63C 17/12; A63C 17/06; A63C 17/08; A63C 17/0046
See application file for complete search history.

(56) References Cited

U.S. PATENT DOCUMENTS

| | | | |
|---|---|---|---|
| 1,585,258 | A | 5/1926 | Arlington |
| 4,023,864 | A | 5/1977 | Lang et al. |
| 4,039,200 | A | 8/1977 | McGonegle |
| 4,106,786 | A | 8/1978 | Talbott |
| 4,109,741 | A | 8/1978 | Gabriel |
| 4,134,599 | A | 1/1979 | DiMille et al. |
| 4,505,477 | A | 3/1985 | Wilkinson |
| 4,757,248 | A | 7/1988 | Fujioka et al. |
| 4,795,181 | A | 1/1989 | Armstrong |
| 4,997,196 | A | 3/1991 | Wood |
| 5,000,470 | A | 3/1991 | Kamler et al. |
| 5,119,277 | A | 6/1992 | Copley et al. |
| 5,132,883 | A | 7/1992 | La Lumandier |

(Continued)

FOREIGN PATENT DOCUMENTS

| | | | |
|---|---|---|---|
| CN | 102527024 | A | 7/2012 |
| CN | 105774992 | A | 7/2016 |

(Continued)

OTHER PUBLICATIONS

Ben Smither, Balancing Scooter / Skateboard:, video, retrieved Sep. 22, 2016 from https://www.youtube.com/watch?v=HGbbag9dkIU, uploaded to YouTube on Mar. 4, 2007.

*Primary Examiner* — Brian L Swenson
(74) *Attorney, Agent, or Firm* — Kolitch Romano Dascenzo Gates LLC

(57) ABSTRACT

A one-wheeled vehicle may comprise a board including first and second deck portions each configured to receive a left or right foot of a rider oriented generally perpendicular to a direction of travel of a board, and a pair of side rails, each of which are coupled to the first and second deck portions at distal ends. A top surface of each side rail defines a generally concave shape, such that a plane connecting distal edges of the end portions of the side rail is spaced apart from the central portion of the side rail. In some examples, a bottom surface of each side rail also defines a generally concave-upward shape. In some examples, a bottom surface of each side rail includes a central cutout.

20 Claims, 8 Drawing Sheets

(56) References Cited

U.S. PATENT DOCUMENTS 5,462,302 A 10/1995 Leitner
5,487,441 A 1/1996 Endo et al.
5,509,679 A 4/1996 Leitner
5,513,080 A 4/1996 Magle et al.
5,553,881 A 9/1996 Klassen et al.
5,628,524 A 5/1997 Klassen et al.
5,794,730 A 8/1998 Kamen
5,931,480 A 8/1999 Schroeder
6,050,357 A 4/2000 Staelin et al.
6,100,680 A 8/2000 Vig et al.
6,206,397 B1 3/2001 Klassen et al.
6,223,104 B1 4/2001 Kamen et al.
6,242,701 B1 6/2001 Breed et al.
6,288,505 B1 9/2001 Heinzmann et al.
6,332,103 B1 12/2001 Steenson, Jr. et al.
6,408,240 B1 6/2002 Morrell et al.
6,488,301 B2 12/2002 Klassen et al.
6,536,788 B1 3/2003 Kuncz et al.
6,538,411 B1 3/2003 Field et al.
6,553,271 B1 4/2003 Morrell
6,561,294 B1 5/2003 Kamen et al.
6,779,621 B2 8/2004 Kamen et al.
6,789,640 B1 9/2004 Arling et al.
6,827,163 B2 12/2004 Amsbury et al.
6,874,591 B2 4/2005 Morrell et al.
6,932,371 B2 8/2005 Perez
6,965,206 B2 11/2005 Kamen et al.
6,992,452 B1 1/2006 Sachs et al.
7,023,330 B2 4/2006 Kamen et al.
7,053,289 B2 5/2006 Wai et al.
RE39,159 E 7/2006 Klassen et al.
7,090,040 B2 8/2006 Kamen et al.
7,091,724 B2 8/2006 Heinzmann et al.
7,130,702 B2 10/2006 Morrell
7,138,774 B2 11/2006 Negoro et al.
7,157,875 B2 1/2007 Kamen et al.
7,172,044 B2 2/2007 Bouvet
7,198,280 B2 4/2007 Hara
7,263,453 B1 8/2007 Gansler et al.
7,424,927 B2 9/2008 Borleske et al.
7,467,681 B2 12/2008 Hiramatsu
7,467,891 B2 12/2008 Gennissen et al.
7,479,097 B2 1/2009 Rosborough et al.
7,581,743 B2 9/2009 Graney
7,592,766 B2 9/2009 Patel et al.
7,740,099 B2 6/2010 Field et al.
7,757,794 B2 7/2010 Heinzmann et al.
7,789,174 B2 9/2010 Kamen et al.
7,811,217 B2 10/2010 Odien
7,857,088 B2 12/2010 Field et al.
7,900,725 B2 3/2011 Heinzmann et al.
7,962,256 B2 6/2011 Stevens et al.
7,963,352 B2 6/2011 Alexander
7,979,179 B2 7/2011 Gansler
7,979,197 B2 7/2011 Finn et al.
8,052,293 B2 11/2011 Hurwitz
8,066,297 B2 11/2011 Beale et al.
8,083,313 B2 12/2011 Karppinen et al.
8,146,696 B2 4/2012 Kaufman
8,170,780 B2 5/2012 Field et al.
8,272,657 B2 9/2012 Graney et al.
8,382,136 B2 2/2013 Beale et al.
8,467,941 B2 6/2013 Field et al.
8,469,569 B1 6/2013 Tunnicliffe et al.
8,490,723 B2 7/2013 Heinzmann et al.
8,543,307 B2 9/2013 Takenaka et al.
8,562,386 B2 10/2013 Carlson et al.
8,567,537 B2 10/2013 Gomi et al.
8,682,487 B2 3/2014 Kurth et al.
9,097,598 B2 8/2015 Grassi
9,101,817 B2 8/2015 Doerksen
9,211,470 B2 12/2015 Bigler
9,344,026 B2 5/2016 Tang
9,387,363 B1 7/2016 Polinsky
9,400,505 B2 7/2016 Doerksen
9,452,345 B2 9/2016 Doerksen et al.
9,598,141 B1 3/2017 Doerksen et al.
9,707,470 B2 7/2017 Ma
9,789,384 B1 10/2017 Ma
9,802,109 B2 10/2017 Doerksen
9,891,624 B2 2/2018 Murakami et al.
9,943,749 B2 4/2018 Cerboneschi
9,956,474 B2 5/2018 Zhou et al.
9,962,597 B2 5/2018 Doerksen et al.
9,999,827 B2 6/2018 Wood
10,010,784 B1 7/2018 Doerksen et al.
10,167,036 B2 1/2019 Ying
10,207,764 B2 2/2019 Li et al.
10,307,659 B2 6/2019 Bigler
10,392,075 B2 8/2019 Otsuki et al.
10,456,658 B1 10/2019 Doerksen
10,682,565 B1 6/2020 Woolson et al.
10,786,726 B2 9/2020 Doerksen et al.
10,913,509 B2 2/2021 Liu
10,933,937 B2 3/2021 Shang
11,045,712 B1 6/2021 Orehek
11,117,474 B2 9/2021 Doerksen et al.
11,130,543 B2 9/2021 Ying
11,136,084 B2 10/2021 Shang
11,325,021 B1 5/2022 McCosker
2002/0074176 A1 6/2002 Justus et al.
2004/0065494 A1 4/2004 Nelson
2004/0207169 A1 10/2004 Kent et al.
2005/0121238 A1 6/2005 Ishii
2005/0126832 A1 6/2005 Amsbury et al.
2005/0241864 A1 11/2005 Hiramatsu
2006/0038520 A1 2/2006 Negoro et al.
2006/0049595 A1 3/2006 Crigler et al.
2006/0170174 A1 8/2006 Hiramatsu
2006/0213711 A1 9/2006 Hara
2006/0260862 A1 11/2006 Nishikawa
2007/0194558 A1 8/2007 Stone et al.
2007/0254789 A1 11/2007 Odien
2008/0294094 A1 11/2008 Mhatre et al.
2009/0178877 A1 7/2009 Keller et al.
2009/0261557 A1 10/2009 Beale et al.
2010/0321149 A1 12/2010 Foster
2010/0330876 A1 12/2010 Carlson et al.
2011/0071711 A1 3/2011 Sharp et al.
2011/0109060 A1 5/2011 Earle et al.
2011/0309772 A1 12/2011 Forgey
2012/0173107 A1 7/2012 Takenaka et al.
2012/0232734 A1 9/2012 Pelletier
2013/0081891 A1 4/2013 Ulmen et al.
2013/0121198 A1 5/2013 Xiao et al.
2013/0175943 A1 6/2013 Tackett
2013/0206493 A1 8/2013 Larson et al.
2014/0172262 A1 6/2014 Andoh
2014/0326525 A1 11/2014 Doerksen
2015/0096820 A1 4/2015 Strack
2015/0107922 A1 4/2015 Bigler
2015/0109722 A1 4/2015 Toyota et al.
2015/0323935 A1 11/2015 Doerksen
2016/0059109 A1 3/2016 Bigler
2016/0121198 A1 5/2016 Doerksen et al.
2016/0129957 A1 5/2016 Murakami et al.
2017/0088212 A1 3/2017 Edney
2017/0120139 A1 5/2017 Ma
2017/0361205 A1 12/2017 Bigler
2017/0361900 A1 12/2017 Doerksen et al.
2018/0056169 A1 3/2018 Doerksen
2018/0099207 A1 4/2018 Doerksen et al.
2018/0111039 A1 4/2018 Wood
2018/0161661 A1 6/2018 Ma et al.
2018/0169506 A1 6/2018 Ma
2019/0024773 A1 1/2019 Rabin et al.
2019/0168102 A1 6/2019 Doerksen et al.
2019/0193803 A1 6/2019 Desberg et al.

(56) References Cited

U.S. PATENT DOCUMENTS

| | | | | |
|---|---|---|---|---|
| 2019/0299082 | A1* | 10/2019 | Hoover | A63C 17/08 |
| 2020/0282293 | A1 | 9/2020 | Turner et al. | |

FOREIGN PATENT DOCUMENTS

| | | | |
|---|---|---|---|
| KR | 1020160088856 | A | 7/2016 |
| KR | 101663781 | B1 | 10/2016 |
| TW | 450823 | B | 8/2001 |
| WO | 9313974 | A1 | 7/1993 |
| WO | 2009071879 | A1 | 6/2009 |
| WO | 2017053443 | A1 | 3/2017 |
| WO | 2017077362 | A1 | 5/2017 |

* cited by examiner

CONCAVE SIDE RAILS FOR ONE-WHEELED VEHICLES

CROSS-REFERENCES

The following applications and materials are incorporated herein, in their entireties, for all purposes: U.S. Pat. Nos. 9,101,817; 9,352,245; 9,452,345; 9,598,141; 9,962,597; 10,272,319; 10,343,050; 10,376,772; and 11,123,629.

FIELD

This disclosure relates to systems and methods for isolating a vehicle frame from certain effects of uneven terrain. More specifically, the disclosed embodiments relate to suspension systems for one-wheeled vehicles.

SUMMARY

The present disclosure provides systems, apparatuses, and methods relating to concave side rails for one-wheeled vehicles.

In some examples, an electric vehicle according to the present disclosure includes: a board including first and second deck portions each configured to receive a left or right foot of a rider oriented generally perpendicular to a direction of travel of the board; a wheel assembly including a rotatable ground-contacting element disposed between and extending above the first and second deck portions; a motor assembly mounted to the board and configured to rotate the ground-contacting element around an axle to propel the electric vehicle; at least one sensor configured to measure orientation information of the board; a motor controller configured to receive orientation information measured by the sensor and to cause the motor assembly to propel the electric vehicle based on the orientation information; and a pair of side rails respectively disposed on each lateral side of the board, each side rail including a first end portion connected to the first deck portion, a second end portion connected to the second deck portion, and a central portion disposed between the first end portion and the second end portion; wherein a top surface of each side rail defines a generally concave shape such that a plane connecting distal edges of the end portions of the side rail is spaced apart from the central portion of the side rail.

In some examples, an electric vehicle according to the present disclosure includes: a board including first and second deck portions each configured to receive a left or right foot of a rider oriented generally perpendicular to a direction of travel of the board; a wheel disposed between and extending above the first and second deck portions; a hub motor configured to rotate the wheel around an axle to propel the electric vehicle; a motor controller configured to cause the hub motor to propel the electric vehicle based on an orientation of the board; and a stabilizing side rail respectively disposed on each lateral side of the board, each side rail including a first end portion connected to the first deck portion and including a first distal edge, a second end portion connected to the second deck portion and including a second distal edge, and a central portion between the end portions; wherein a top surface of each side rail defines a generally concave shape such that a plane connecting distal edges of the side rail is spaced apart from the central portion of the side rail.

In some examples, an electric vehicle according to the present disclosure includes: a board including first and second deck portions; a wheel disposed between and extending above the first and second deck portions; a hub motor configured to rotate the wheel; one or more sensors configured to determine an orientation of the board; a motor controller configured to cause the hub motor to rotate based on the orientation of the board; and a side rail attached to each lateral side of the board, each side rail including a first end portion connected to the first deck portion, a second end portion connected to the second deck portion, and a central portion between the end portions; wherein a top surface of each side rail defines a generally concave shape such that a plane tangent to the end portions of the side rail is spaced apart from a top surface of the central portion of the side rail.

Features, functions, and advantages may be achieved independently in various embodiments of the present disclosure, or may be combined in yet other embodiments, further details of which can be seen with reference to the following description and drawings.

DETAILED DESCRIPTION

Figure 1:
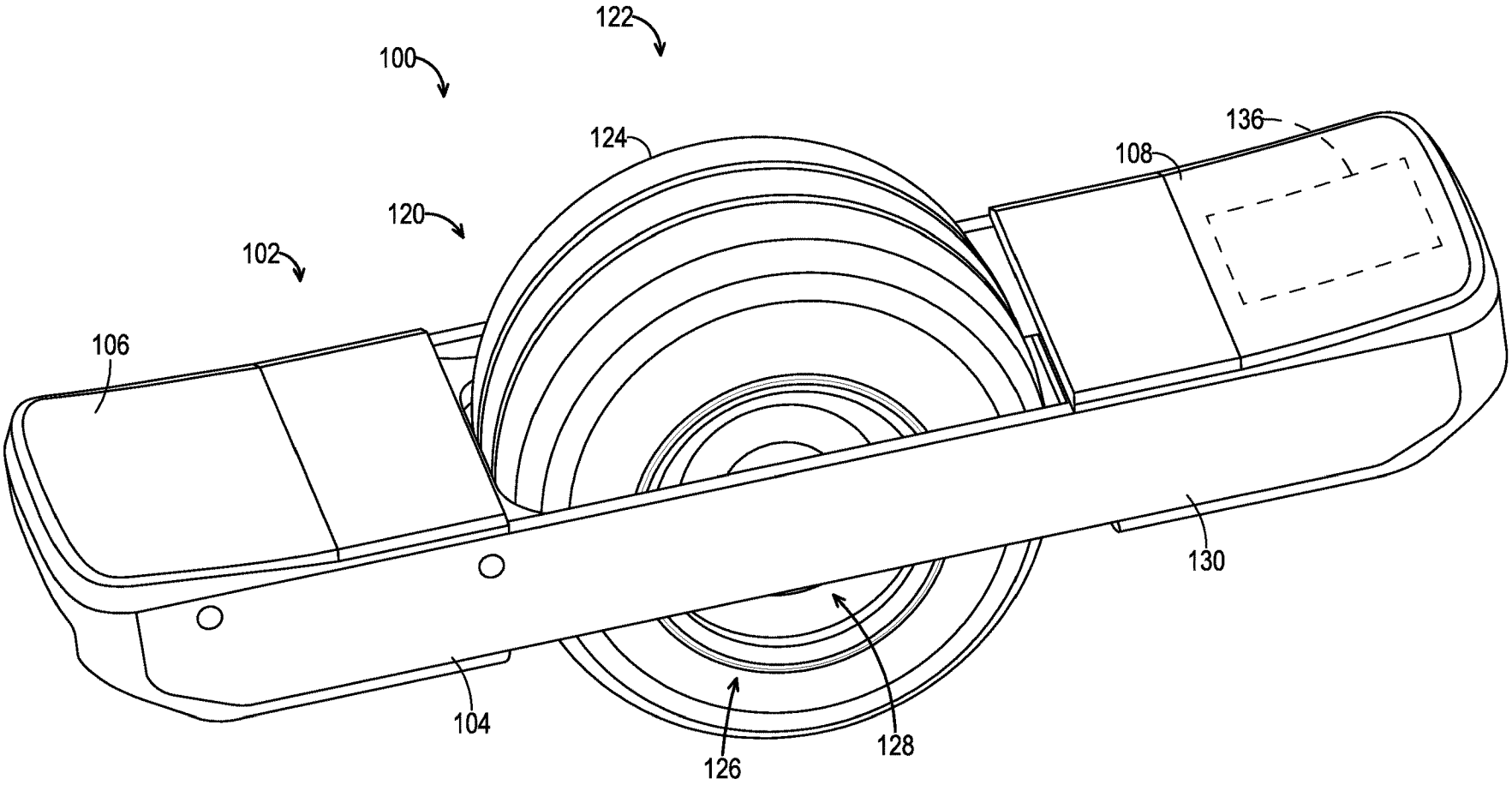
FIG. 1 is an isometric view of a one-wheeled vehicle in accordance with aspects of the present disclosure.

Various aspects and examples of concave side rails for one-wheeled vehicles, as well as related methods, are described below and illustrated in the associated drawings. Unless otherwise specified, a one-wheeled vehicle in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections, each of which is labeled accordingly.

Definitions

The following definitions apply herein, unless otherwise indicated.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Elongate" or "elongated" refers to an object or aperture that has a length greater than its own width, although the width need not be uniform. For example, an elongate slot may be elliptical or stadium-shaped, and an elongate candlestick may have a height greater than its tapering diameter. As a negative example, a circular aperture would not be considered an elongate aperture.

The terms "inboard," "outboard," "forward," "rearward," and the like are intended to be understood in the context of a host vehicle on which systems described herein may be mounted or otherwise attached. For example, "outboard" may indicate a relative position that is laterally farther from the centerline of the vehicle, or a direction that is away from the vehicle centerline. Conversely, "inboard" may indicate a direction toward the centerline, or a relative position that is closer to the centerline. Similarly, "forward" means toward the front portion of the vehicle, and "rearward" means toward the rear of the vehicle. In the absence of a host vehicle, the same directional terms may be used as if the vehicle were present. For example, even when viewed in isolation, a device may have a "forward" edge, based on the fact that the device would be installed with the edge in question facing in the direction of the front portion of the host vehicle.

"Coupled" means connected, either permanently or releasably, whether directly or indirectly through intervening components.

"Resilient" describes a material or structure configured to respond to normal operating loads (e.g., when compressed) by deforming elastically and returning to an original shape or position when unloaded.

"Rigid" describes a material or structure configured to be stiff, non-deformable, or substantially lacking in flexibility under normal operating conditions.

"Elastic" describes a material or structure configured to spontaneously resume its former shape after being stretched or expanded.

A "controller" or "electronic controller" includes processing logic programmed with instructions to carry out a controlling function with respect to a control element. For example, an electronic controller may be configured to receive an input signal, compare the input signal to a selected control value or setpoint value, and determine an output signal to a control element (e.g., a motor or actuator) to provide corrective action based on the comparison. In another example, an electronic controller may be configured to interface between a host device (e.g., a desktop computer, a mainframe, etc.) and a peripheral device (e.g., a memory device, an input/output device, etc.) to control and/or monitor input and output signals to and from the peripheral device.

Directional terms such as "up," "down," "vertical," "horizontal," and the like should be understood in the context of the particular object in question. For example, an object may be oriented around defined X, Y, and Z axes. In those examples, the X-Y plane will define horizontal, with up being defined as the positive Z direction and down being defined as the negative Z direction.

"Providing," in the context of a method, may include receiving, obtaining, purchasing, manufacturing, generating, processing, preprocessing, and/or the like, such that the object or material provided is in a state and configuration for other steps to be carried out.

In this disclosure, one or more publications, patents, and/or patent applications may be incorporated by reference. However, such material is only incorporated to the extent that no conflict exists between the incorporated material and the statements and drawings set forth herein. In the event of any such conflict, including any conflict in terminology, the present disclosure is controlling.

Overview

In general, side rails (AKA stabilizing side rails) according to the present teachings are configured to be utilized with one-wheeled electric vehicles having suspension systems. One-wheeled electric vehicles of the present disclosure are self-stabilizing skateboards substantially similar in non-suspension aspects to the electric vehicles described in U.S. Pat. No. 9,101,817 (the '817 patent). Accordingly, one-wheeled vehicles of the present disclosure include a board defining a riding plane and a frame supporting a first deck portion and a second deck portion (collectively referred to as the foot deck). Each deck portion is configured to receive a left or right foot of a rider oriented generally perpendicular to a direction of travel of the board.

One-wheeled vehicles of the present disclosure include a wheel assembly having a rotatable, ground-contacting element (e.g., a tire, wheel, or continuous track) disposed between and extending above the first and second deck portions. The wheel assembly further includes a hub motor configured to rotate the ground-contacting element to propel the vehicle.

As described in the '817 patent, the one-wheeled vehicle includes at least one sensor configured to measure orientation information of the board, and a motor controller configured to receive orientation information measured by the sensor and to cause the hub motor to propel the vehicle based on the orientation information.

The deck portions may include any suitable structures configured to support the feet of a rider, such as non-skid surfaces, as well as vehicle-control features, such as a rider detection system. Illustrative deck portions, including suitable rider detection systems, are described in the '817 patent, as well as in U.S. Pat. No. 9,352,245.

The frame may include any suitable structure configured to rigidly support the deck portions and to be coupled to an axle of the wheel assembly via a suspension system, such that the weight of a rider may be supported on the tiltable board, having a fulcrum at the wheel assembly axle. In some examples, such as the examples depicted herein, the suspension system is a swingarm-type suspension, having a swingarm dampened by a damper or shock absorber (e.g., a gas spring). In some examples, the suspension system is any suitable suspension system, such as the suspension systems described in U.S. Pat. Nos. 9,962,597; 10,010,784; 10,343,050; 10,343,051; 10,376,772; and/or 11,123,629.

Specifically, in a one-wheeled electric vehicle according to the present teachings, the frame includes one or more side rails (AKA frame portions, stabilizing side rails) on which the deck portions are mounted. In some examples, the frame includes a pair of side rails, each of which is coupled to the first deck at a first end and coupled to the second deck at a second end. The side rails are disposed on opposing lateral sides of the board, such that the wheel assembly is disposed between the side rails. As the frame of a one-wheeled vehicle including a suspension system generally will move up and down with respect to the wheel assembly, the side rails are shaped to provide additional clearance both at the first end (AKA tip) and second end (AKA tail) of the side rails. Accordingly, a top surface of each side rail defines a generally upward-angled shape (AKA concave), such that an imaginary plane connecting the first and second ends of each rail is spaced apart from a central portion of the side rail. Similarly, a bottom surface of each rail may define a generally upward-angled shape. In other words, each rail includes a central portion which is disposed closer to an underlying surface than the first and second ends when the one-wheeled vehicle is in a neutral (e.g., resting) position, wherein the first and second ends are level. As the frame tilts during vehicle operation, the upward-angled shape of the side rails facilitates increased range of motion before the first and second ends of the rails contact the ground.

Specifically, in one-wheeled vehicles including suspension systems, the board may move down with respect to the wheel, resulting in a decreased range of tilt motion before an end of the board would make contact with the ground. An upward-angled frame shape may provide one-wheeled vehicles having suspension systems with greater ranges of motion, such as ranges of motion comparable to one-wheeled vehicles with fixed board-to-wheel heights. The frame may support one or more additional elements and features of the vehicle, e.g., a charging port, end bumpers, lighting assemblies, battery and electrical systems, electronics, controllers, etc.

In some examples, a top surface of each side rail has a substantially concave shape, such that each top surface defines a curve having a projected center of curvature disposed above the deck of the one-wheeled vehicle. In some examples, a top surface of each side rail is continually curved between distal edges of the end portions of the side rail, whereas in other examples, some portions (but not all) of the top surface of each side rail may be curved, and/or the curvature of curved portions of the top rail may vary. In some examples, a top surface of each side rail comprises two or more segments, each having a different projected centers of curvature. In some examples, the first and second rails each comprise three segments of differing curvature that collectively define the generally concave shape. In each of the above examples, a midpoint of each rail is disposed below a plane connecting distal ends of each rail.

In some examples, a top surface of each side rail includes a plurality of linear segments that collectively define a generally concave shape. The top surface may include any suitable number of segments (e.g., two, three, etc.). In some examples, the top surface includes three linear segments collectively defining a generally concave shape. For example, the top surface may comprise a central horizontal segment oriented substantially parallel to the board, and first and second angled segments which slope downward from the first and second ends of the board toward the central horizontal segment. In some examples, the top surface of each side rail may include a mixture of curved and linear segments, configured to collectively define a generally concave shape.

In some examples, a bottom surface of each side rail may have a shape which essentially replicates the shape of the top surface of the corresponding side rail, including any curved and/or linear sections. In other example, the bottom surface of each side rail may be shaped differently from the top surface of the corresponding side rail, but still maintain a generally concave-upward shape to provide additional clearance for the tip and tail of the board as described previously. In still other examples, the top surfaces of the side rails may have a generally concave shape, whereas the bottom surface of each side rail may not have a generally concave-upward shape. This may not provide additional ground clearance for the tip and tail of the board, but still provides a different and potentially more desirable rider experience, at least for some riders.

In some examples, a bottom surface of each side rail includes a central cutout (AKA camber cutout). In some examples, the central cutout is configured to expose the suspension system, e.g., to allow more convenient access to the suspension system. In some examples, the central cutout is substantially concave in shape. In some examples, the central cutout is configured to expose suspension features, such as axle mounting members (AKA axle bolts), portions of the swingarm, a shock absorber adjustment mechanism, and/or the like, facilitating adjustment of the suspension system by a rider or other person.

As mentioned above, the hub motor is controlled by a motor controller configured to receive orientation information regarding the board. Aspects of the electrical control systems described herein (e.g., the motor controller) may be embodied as a computer method, computer system, or computer program product. Accordingly, aspects of the present control systems may include processing logic and may take the form of an entirely hardware embodiment, an entirely software embodiment (including firmware, resident software, micro-code, and the like), or an embodiment combining software and hardware aspects, all of which may generally be referred to herein as a "circuit," "module," or "system." Furthermore, aspects of the present control systems may take the form of a computer program product embodied in a computer-readable medium (or media) having computer-readable program code/instructions embodied thereon.

Any combination of computer-readable media may be utilized. Computer-readable media can be a computer-readable signal medium and/or a computer-readable storage medium. A computer-readable storage medium may include an electronic, magnetic, optical, electromagnetic, infrared, and/or semiconductor system, apparatus, or device, or any suitable combination of these. More specific examples of a computer-readable storage medium may include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, and/or any suitable combination of these and/or the like. In the context of this disclosure, a computer-readable storage medium may include any suitable non-transitory, tangible medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, and/or any suitable combination thereof. A computer-readable signal medium may include any computer-readable medium that is not a computer-readable storage medium and that is capable of communicating, propagating, or transporting a program for use by or in connection with an instruction execution system, apparatus, or device.

Program code embodied on a computer-readable medium may be transmitted using any appropriate medium, including but not limited to wireless, wireline, optical fiber cable, RF, and/or the like, and/or any suitable combination of these.

Computer program code for carrying out operations for aspects of the present control systems may be written in one or any combination of programming languages, including an object-oriented programming language such as Java, C++, and/or the like, and conventional procedural programming languages, such as C. Mobile apps may be developed using any suitable language, including those previously mentioned, as well as Objective-C, Swift, C #, HTML5, and the like. The program code may execute entirely on a user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), and/or the connection may be made to an external computer (for example, through the Internet using an Internet Service Provider).

Aspects of the present control systems are described below with reference to flowchart illustrations and/or block diagrams of methods, apparatuses, systems, and/or computer program products. Each block and/or combination of blocks in a flowchart and/or block diagram may be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block(s). In some examples, machine-readable instructions may be programmed onto a programmable logic device, such as a field programmable gate array (FPGA).

These computer program instructions can also be stored in a computer-readable medium that can direct a computer, other programmable data processing apparatus, and/or other device to function in a particular manner, such that the instructions stored in the computer-readable medium produce an article of manufacture including instructions which implement the function/act specified in the flowchart and/or block diagram block(s).

The computer program instructions can also be loaded onto a computer, other programmable data processing apparatus, and/or other device to cause a series of operational steps to be performed on the device to produce a computer-implemented process such that the instructions which execute on the computer or other programmable apparatus provide processes for implementing the functions/acts specified in the flowchart and/or block diagram block(s).

Any flowchart and/or block diagram in the drawings is intended to illustrate the architecture, functionality, and/or operation of possible implementations of systems, methods, and computer program products according to aspects of the present control systems. In this regard, each block may represent a module, segment, or portion of code, which comprises one or more executable instructions for implementing the specified logical function(s). In some implementations, the functions noted in the block may occur out of the order noted in the drawings. For example, two blocks shown in succession may, in fact, be executed substantially concurrently, or the blocks may sometimes be executed in the reverse order, depending upon the functionality involved. Each block and/or combination of blocks may be implemented by special purpose hardware-based systems (or combinations of special purpose hardware and computer instructions) that perform the specified functions or acts. are described in greater detail below.

Examples, Components, and Alternatives

The following sections describe selected aspects of illustrative concave side rails for one-wheeled vehicles, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. One-Wheeled Vehicle Having a First Illustrative Suspension System With reference to FIGS. 1-7, this section describes a one-wheeled vehicle 100 having a suspension system 150, which is an example of the suspension system described above.

Vehicle 100 is a one-wheeled, self-stabilizing skateboard including a board 102 (AKA a tiltable portion of the vehicle, a platform, a foot deck) having a frame 104 supporting a first deck portion 106 and a second deck portion 108 defining an opening 120 therebetween. Frame 104 comprises two side rails 130, each of which couples to first deck portion 106 and second deck portion 108 at distal ends. Board 102 may generally define a plane. Each deck portion 106, 108 (e.g., including a foot pad) is configured to receive and support a left or right foot of a rider oriented generally perpendicular to a direction of travel of the board.

Vehicle 100 also includes a wheel assembly 122. Wheel assembly 122 includes a rotatable ground-contacting element 124 (e.g., a tire, wheel, or continuous track) disposed between and extending above first and second deck portions 106, 108, and a motor assembly 126 configured to rotate ground-contacting element 124 to propel the vehicle. As shown in FIG. 1 and elsewhere, vehicle 100 may include exactly one ground-contacting element, disposed between the first and second deck portions. In some examples, vehicle 100 may include a plurality of (e.g., coaxial) ground-contacting elements.

Wheel assembly 122 is disposed between first and second deck portions 106, 108. Ground-contacting element 124 is coupled to motor assembly 126. An axle 128 (AKA a shaft) of motor assembly 126 is coupled to board 102 via suspension system 150. Motor assembly 126 is configured to rotate ground-contacting element 124 around (or about) axle 128 to propel vehicle 100. For example, motor assembly 126 may include an electric motor, such as a hub motor, configured to rotate ground-contacting element 124 about axle 128 to propel vehicle 100 along the ground. For convenience, ground-contacting element 124 is hereinafter referred to as a tire or wheel, although other suitable embodiments may be provided.

First and second deck portions 106, 108 are located on opposite sides of wheel assembly 122, with board 102 being dimensioned to approximate a skateboard. In other embodiments, the board may approximate a longboard skateboard, snowboard, surfboard, or may be otherwise desirably dimensioned. In some examples, deck portions 106, 108 of board 102 are at least partially covered with a non-slip material (e.g., grip tape or other textured material) to aid in rider control.

Frame 104 may include any suitable structure configured to rigidly support the deck portions and to be coupled to the axle of the wheel assembly by way of the suspension system, such that the weight of a rider is supportable on tiltable board 102. Frame 104 generally has a fulcrum at the wheel assembly axle. Frame 104 includes one or more side rails 130, on which deck portions 106 and 108 are mounted, and which may further support additional elements and features of the vehicle, such as a charging port 132 and a power switch 134. Additionally, end bumpers, lighting assemblies, and other physical or electrical systems may be supported by side rail(s) 130.

Vehicle 100 includes an electrical control system 136. Electrical control system 136 is an example of electrical control system 300 described below with respect to FIG. 14. Aspects of electrical control system 136 may be incorporated into first and/or second deck portions 106, 108. The electrical control system is described further below in Section C.

Wheel 124 is configured to be wide enough in a heel-toe direction that the rider can balance in the heel-toe direction manually, i.e., by shifting his or her own weight, without automated assistance from the vehicle. Ground contacting member 124 may be tubeless, or may be used with an inner tube. In some examples, ground contacting member 124 is a non-pneumatic tire. For example, ground contacting member 124 may be "airless", solid, and/or may comprise a foam. Ground contacting member 124 may have a profile such that the rider can lean vehicle 100 over an edge of the ground contacting member through heel and/or toe pressure to facilitate cornering of vehicle 100.

Motor assembly 126 may include any suitable driver of ground contacting member 124, such as a hub motor mounted within ground contacting portion 124. The hub motor may be internally geared or may be direct-drive. The use of a hub motor facilitates the elimination of chains and belts, and enables a form factor that considerably improves maneuverability, weight distribution, and aesthetics. Mounting ground contacting portion 124 onto motor assembly 126 may be accomplished by a split-rim design (e.g., using hub adapters) which may be bolted on to motor assembly 126, by casting or otherwise providing a housing of the hub motor such that it provides mounting flanges for a tire bead directly on the housing of the hub motor, or any other suitable method.

Figure 2:
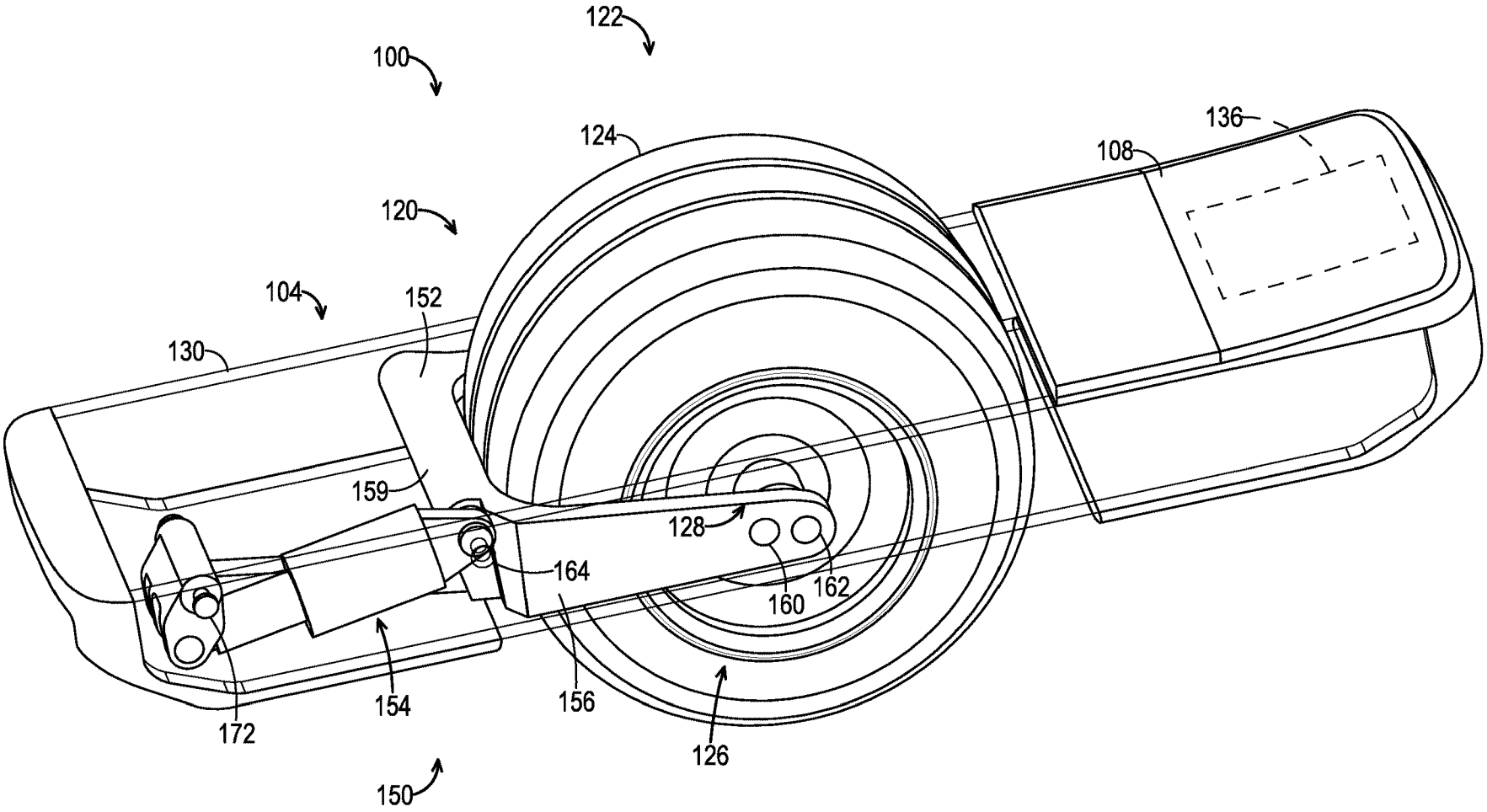
FIG. 2 is an isometric view of the one-wheeled vehicle of FIG. 1 having a first illustrative suspension system.
Figure 3:
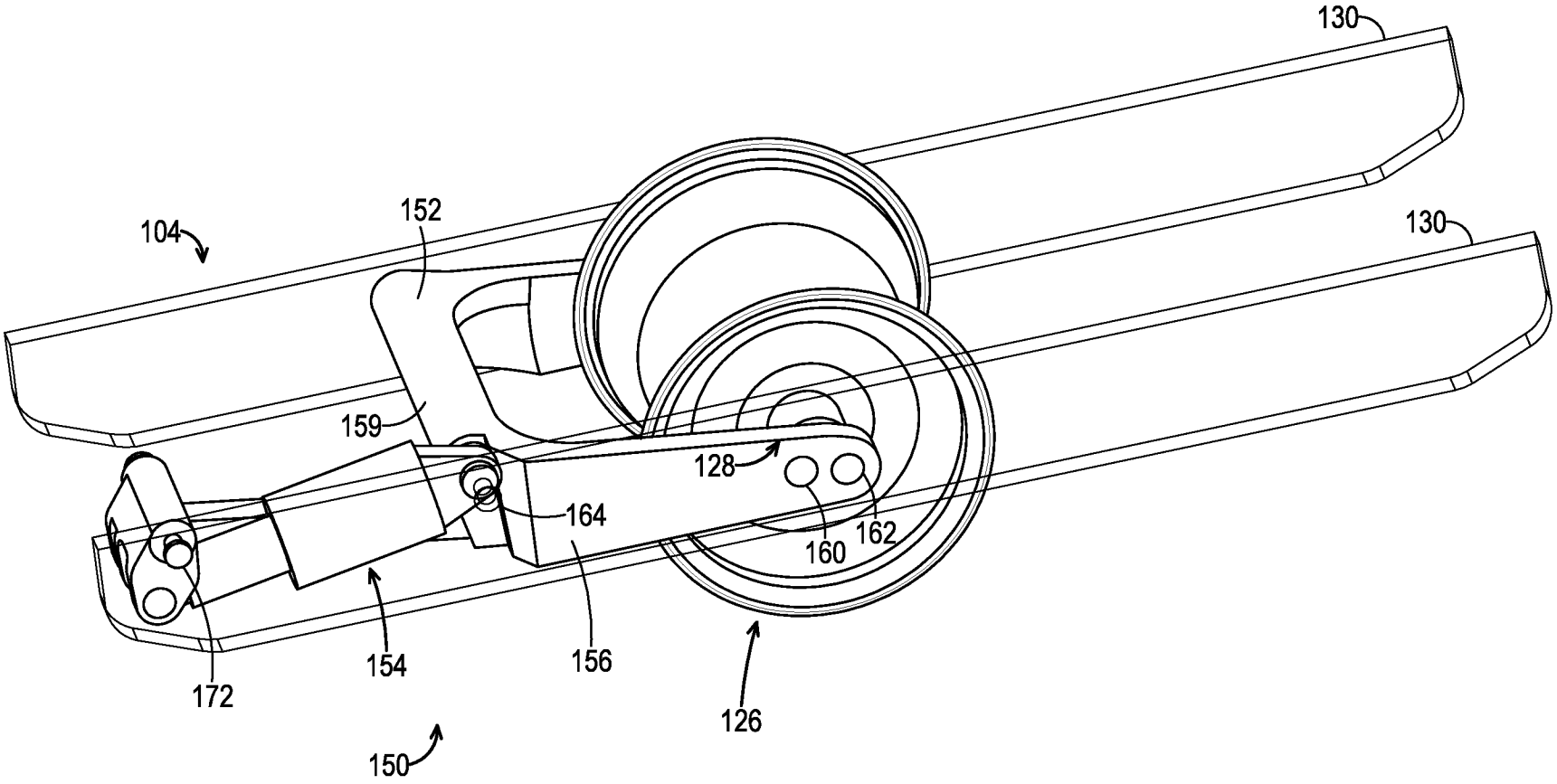
FIG. 3 is another isometric view of the suspension system of FIG. 2.
Figure 4:
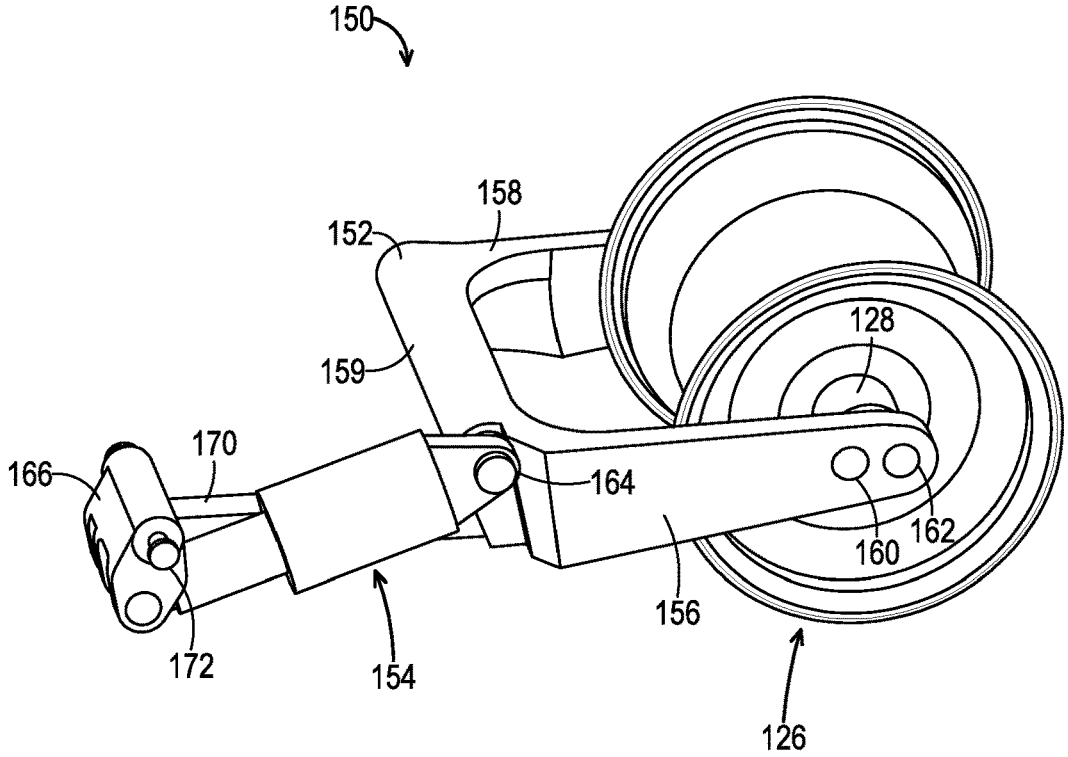
FIG. 4 is another isometric view of the suspension system of FIG. 2.
Figure 5:
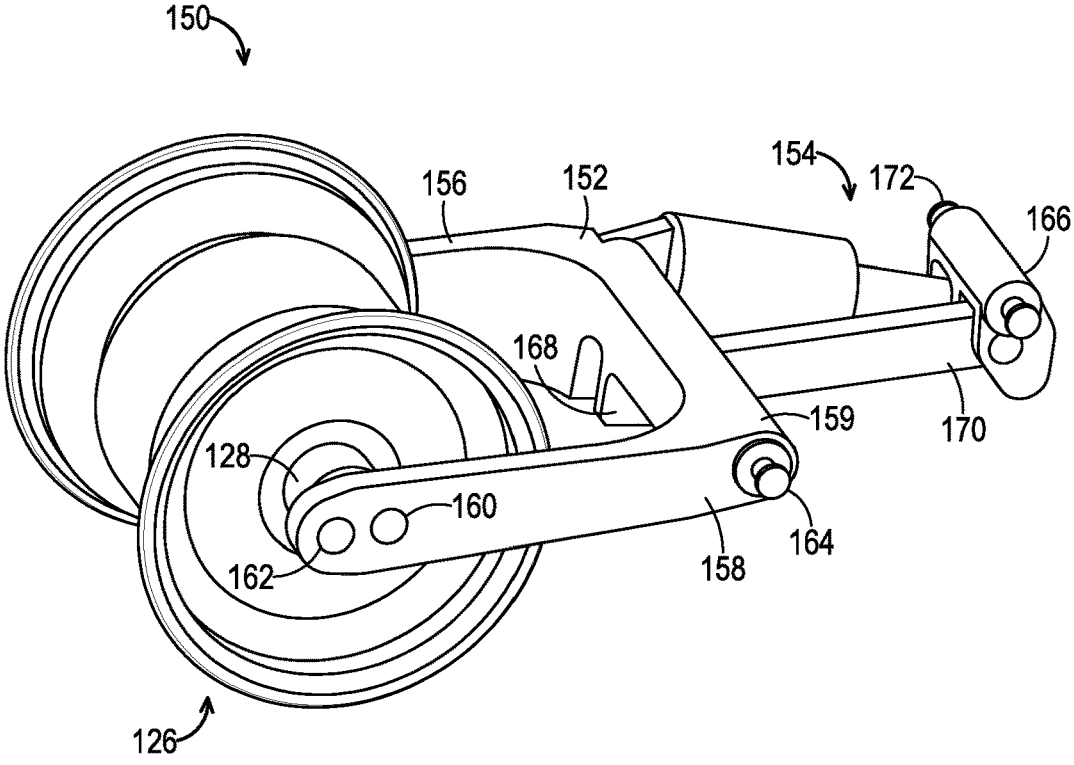
FIG. 5 is another isometric view of the suspension system of FIG. 2.

As shown in FIGS. 2 and 3, motor assembly 126, and therefore ground contacting member 124, are coupled to frame 104 by suspension system 150. Suspension system 150 is an example of suitable suspension systems for use in vehicle 100, although any suitable suspension system may be used.

Suspension system 150 includes a swingarm 152 and a shock absorber 154, as mentioned above. Swingarm 152 is an inflexible, substantially U-shaped structure having a pair of rigid, spaced-apart arms 156, 158. Arms 156 and 158 extend longitudinally (with respect to the board) from a transverse, pivoting cross member 159 (also referred to as a connecting member) to straddle motor assembly 126 and ground contacting member 124.

More specifically, the respective distal ends of arms 156 and 158 are coupled to opposing ends of axle 128. Arms 156 and 158 are fixed to axle 128, such that the swing arm and the axle rotate together (i.e., the swing arm does not rotate with respect to the axle). As shown in FIG. 2 and elsewhere, end portions of arms 156, 158 are each attached to a respective end of axle 128 using a pair of spaced apart axle mounting members 160, 162. In the example shown in FIG. 2, axle mounting members 160, 162 are removable fasteners. The use of two mounting members on each end of the axle enables the board to be tilted/rotated, e.g., while riding, without risking the unthreading or otherwise loosening of the mounting members from the axle. Additionally, the two mounting members rigidly connect the swingarm to the axle such that the swingarm cannot pivot or otherwise rotate with respect to the axle.

At the proximal end of arms 156, 158, swingarm 152 is pivotably attached at cross member 159 to vehicle 100 by support members 164. Support members 164 are affixed (e.g., bolted) to side rails 130 of board 102, and are configured to pivotably retain an end portion of cross member 159. In some examples, the support members are unitary with side rails 130 (e.g., the side rails and the support members are formed as a single piece).

Accordingly, swingarm 152 is pivotable about support members 164 with respect to board 102 and frame 104. This pivotable arrangement facilitates a swinging, generally vertical movement of motor assembly 126 (and therefore wheel assembly 122) with respect to the board. In other words, the wheel can move up and down with respect to the board (i.e., deck portions), through an arc corresponding to a radius defined by extension arms 156 and 158 (i.e., arcuate motion, also referred to as arcuately vertical). The arcuate motion is shown in a dotted curve 167 in FIG. 6.

However, this motion of the wheel is generally only desirable in response to a need, such as when riding the vehicle over a bump in the road or on uneven terrain. Furthermore, the motion should be controlled or damped to allow for rider control and comfort. Accordingly, suspension system 150 includes shock absorber 154 (e.g., a gas spring), configured to bias the swing arm and board toward a desired riding configuration (e.g., board height and orientation with respect to the axle), including when the rider is aboard. Shock absorber 154 is pivotably coupled at a first end 163 to swingarm 152 and pivotably coupled at a second end 165 to a rocker 166. Shock absorber 154 may include any suitable damping device. In this example, shock absorber 154 includes an air shock absorber. Damping characteristics of the shock may be adjustable or selectable. In some examples, the shock may include a lockout feature.

Figure 6:
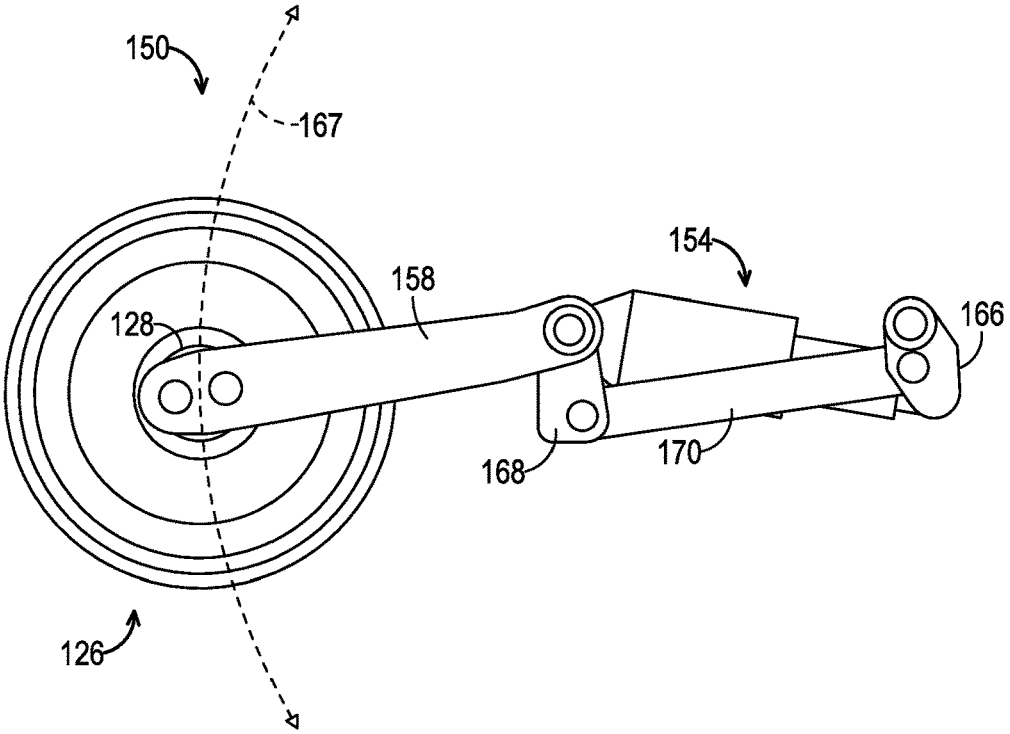
FIG. 6 is a side elevation view of the suspension system of FIG. 2.
Figure 7:
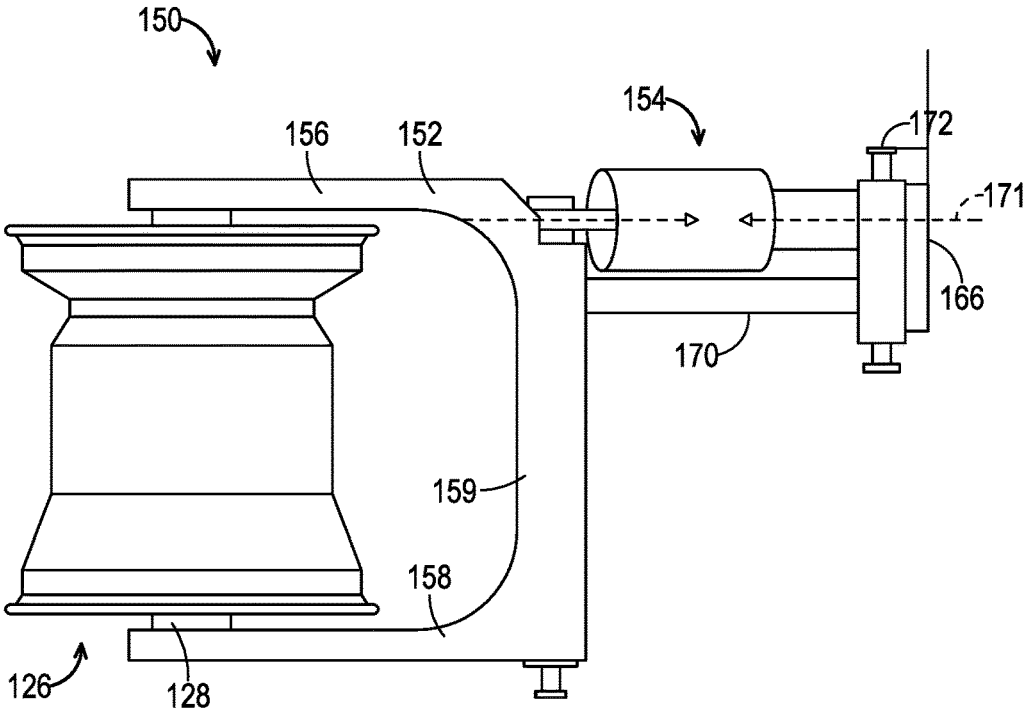
FIG. 7 is a plan view of the suspension system of FIG. 2.

As shown in FIGS. 6 and 7, the pivotal connection of shock absorber 154 at first end 163 and the pivotal connection of swingarm 152 at support members 164 share a common rotational axis through cross member 159.

Swingarm 152 includes a vertical extension 168 (see FIGS. 5 and 6) extending generally downward from a proximal end of extension arm 156 below cross member 159. A pushrod 170 is pivotably attached at a first end to vertical extension 168 of swingarm 152 and pivotably attached at a second end to rocker 166. Rocker 166 is pivotably attached to at least side rail 130 at support member 172.

In operation, the upward arcuate motion of wheel assembly 122 about support members 164, as depicted in FIG. 6, thereby causes a corresponding rotation of vertical extension 168. This rotation pulls pushrod 170 generally toward wheel assembly 122, thereby causing a rotation of rocker 166 about support member 172. According, the rotation of rocker 166 causes a compression in shock absorber 154 as shown by dotted lines 171 in FIG. 7.

Returning to FIG. 2, the arcuate motion of wheel assembly 126 corresponds to the rotation of arms 156, 158 with respect to side rails 130. Accordingly, bumpers 174, 176 are disposed on an upper lip of side rails 130, each bumper corresponding to one of arms 156, 158. In the case that the rider experiences a large enough bump while riding, wheel assembly 122 will move generally upward with respect to board 102 as described above, thereby causing arms 156, 158 to contact or abut bumpers 174, 176 and be arrested thereby. This configuration prevents arms 156, 158 from directly striking side rails 130. Bumpers 174, 176 may comprise any suitable impact absorbing material, such as a rubber or other elastomer.

C. Illustrative Side Rails for Use with One-Wheeled Vehicles

Figure 8:
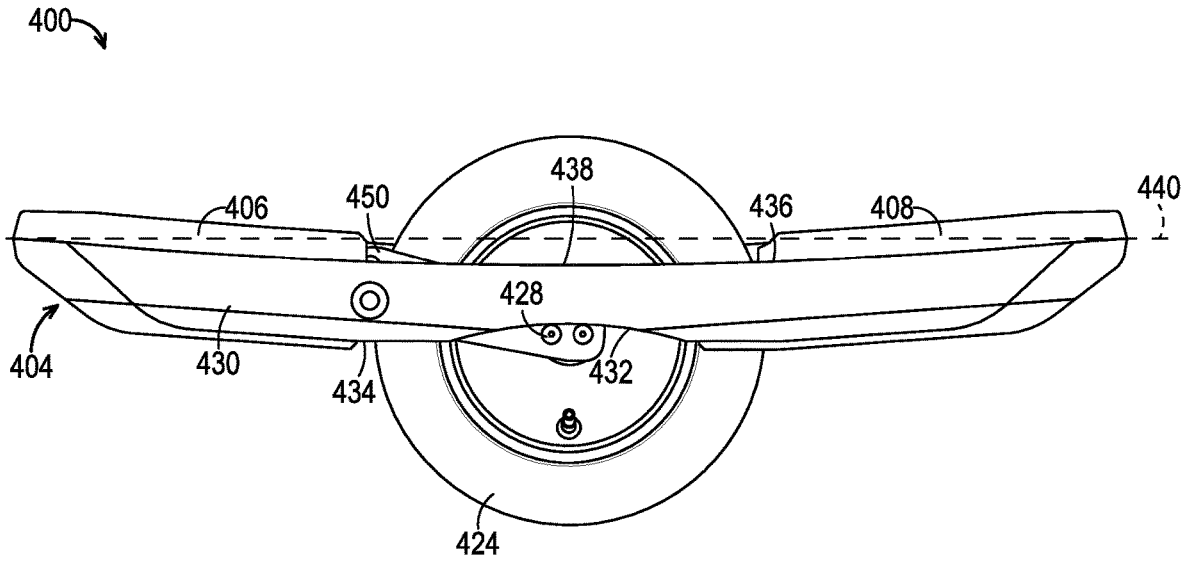
FIG. 8 is a side elevation view of a first one-wheeled vehicle having concave side rails.
Figure 9:
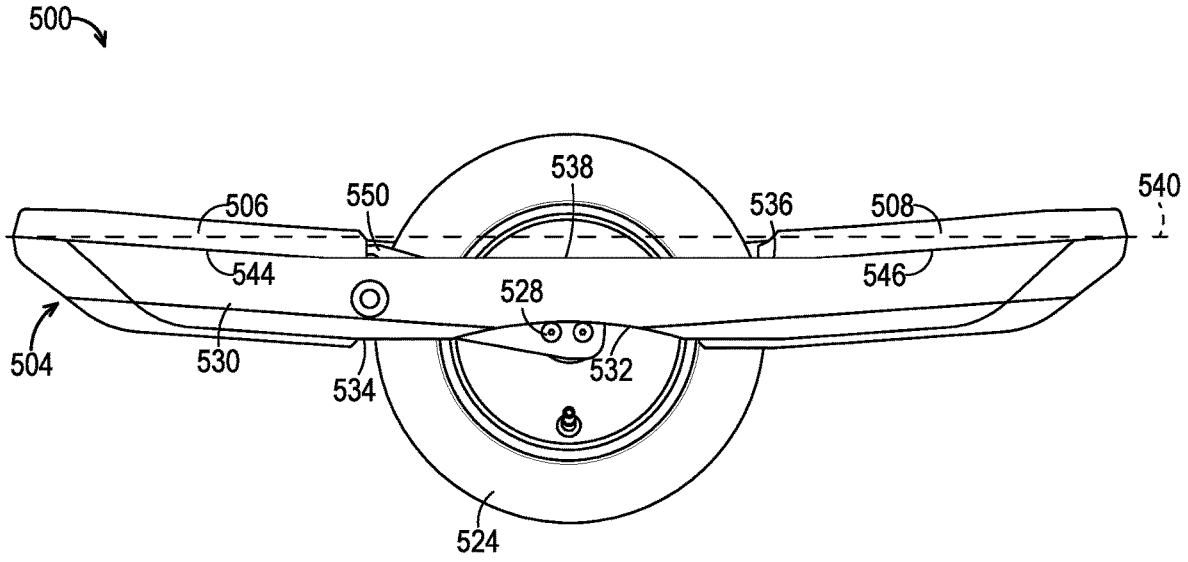
FIG. 9 is a side elevation view of a second one-wheeled vehicle having concave side rails.
Figure 10:
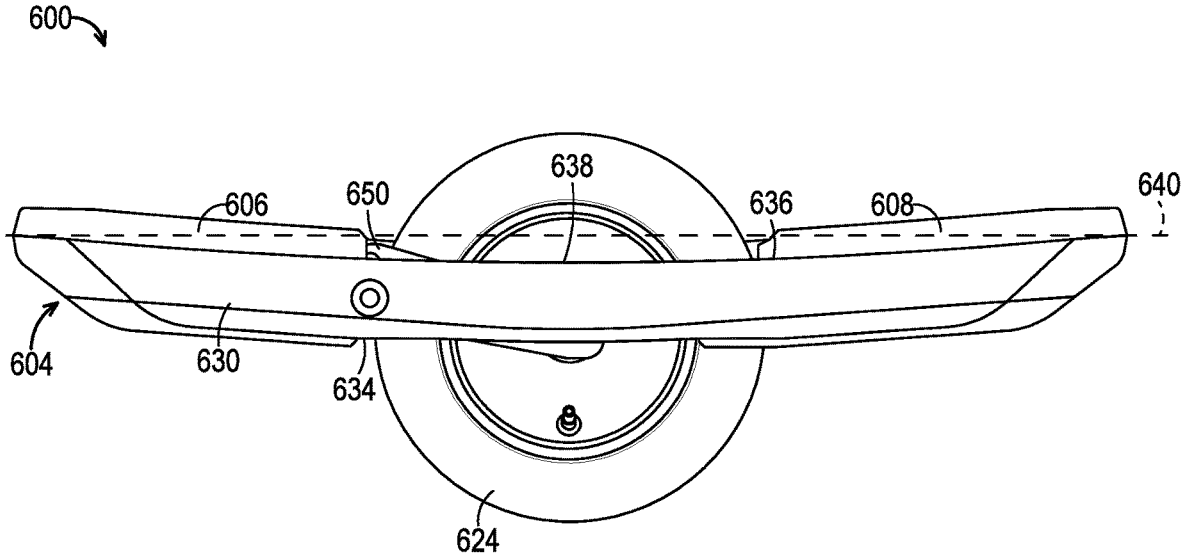
FIG. 10 is a side elevation view of a third one-wheeled vehicle having concave side rails.

FIGS. 8, 9, and 10 depict illustrative vehicles 400, 500, 600 including concave side rails (AKA stabilizing side rails) 430, 530, 630, which are suitable for use with one-wheeled vehicles according to the present teachings. Illustrative vehicles 400, 500, and 600 may be substantially identical to vehicle 100 except as otherwise described.

As described above with respect to vehicle 100, electric one-wheeled vehicles 400, 500, 600 according to the present disclosure have a frame 404, 504, 604 supporting a first deck portion 406, 506, 606, and a second deck portion 408, 508 608 defining an opening therebetween. The frame comprises two side rails 430, 530, 630 each of which couples to the first deck portion and the second deck portion at distal ends. Accordingly, the side rails and deck portions of the frame collectively define an opening through which a rotatable ground-contacting element 424, 524, 624 (e.g., a tire, wheel, or continuous track) extends, and the pair of side rails are respectively disposed on each lateral side of the board. Each deck portion (e.g., including a foot pad) is configured to receive and support a left or right foot of a rider oriented generally perpendicular to a direction of travel of the board.

Side rails 430, 530, and 630 are configured to rigidly support the deck portions, and are coupled to an axle 428, 528, 628 of ground-contacting element 424, 524, 624 by way of a suspension system 450, 550, 650. As side rails 430, 530, and 630 are indirectly coupled to the axle, a bottom surface 434, 534 of side rails 430 and 530 may include a central cutout (AKA central concave camber cutout) 432, 532, which is configured to facilitate access to the axle and suspension system. As can be seen in vehicle 100, side rails of electric vehicles including suspension systems may inadvertently block access to central mechanical components of the electric vehicles, such as the axle bolts, axle mounting members, and/or the like, complicating repair and maintenance. Central cutout 432 and 532 may facilitate maintenance and tuning of the suspension system while the ground-contacting element is coupled to the frame, and may facilitate easy removal of the ground-contacting element. Central cutouts 432 and 532 may have any suitable shape configured to provide access to the axle, such as semi-circular, trapezoidal, semi-ovular, oblong, semi-almond shaped, semi-stadium shaped, and/or the like. In some examples, such as in the example depicted in FIG. 10, a bottom surface 634 of side rails 630 may define a single continuous arc, without cutouts or discontinuities.

As described above, deck portions 406, 506, 606, 408, 508, 608 are mounted and/or coupled to distal ends of side rails 430, 530, 630. The side rails are disposed on opposing lateral sides of the board, such that the ground-contacting element is disposed between the side rails. A top surface 436, 536, 636 of each side rail defines a generally upward-angled (AKA concave) shape, such that a plane 440, 540, 640 connecting the distal ends of each rail 430, 530, 630 is spaced apart from a central portion 438, 538, 638 of the side rail. In other words, each rail includes a central portion 438, 538, 638 which is disposed closer to an underlying surface than the distal ends when the one-wheeled vehicle is in a neutral (e.g., resting) position, and when the frame is substantially level.

The bottom surfaces of each side rail have generally concave-upward shapes, corresponding to the generally concave shape of the top surfaces of the side rails. Accordingly, as the frame tilts during vehicle operation, the upward-angled shape of the side rails facilitates increased range of motion before the first and second ends of the rails contact the ground. Specifically, in one-wheeled vehicles including suspension systems, the board may move closer to the ground as a result of force applied to the suspension system, resulting in a decreased range of tilt motion. An upward-angled frame shape may provide additional clearance at the distal ends of the frame, and accordingly increased range of motion when the board is closer to the ground.

In some examples, a top surface 436, 536, 636 of each side rail has a substantially concave shape, such that each top surface defines a curve having a projected center of curvature disposed above the deck of the one-wheeled vehicle. In some examples, such as in the example depicted in FIGS. 8 and 10, a top surface 436, 636 of each side rail is continually curved between distal edges of the end portions of the side rail.

In some examples, such as in the example depicted in FIG. 9, a top surface 536 of each side rail includes a plurality of linear segments that collectively define a generally concave shape. The top surface may include any suitable number of segments (e.g., two, three, etc.). In some examples, the top surface includes three linear segments collectively defining a generally concave shape. For example, the top surface comprises a central horizontal segment 538 oriented substantially parallel to the board, and first and second angled segments 544, 546, which slope downward between the first and second ends of the board and the central horizontal segment. In some examples, a top surface 436, 536, 636 of each side rail comprises two or more segments, each having a different projected centers of curvature.

In some examples, the first and second rails each comprise three segments of differing curvature that collectively define the generally concave shape. In each of the above examples, a midpoint or central portion of each rail is disposed below a plane connecting or tangent to distal edges (AKA distal end portions) of each rail.

In some examples, curved rails as described above may improve sensitivity of gyro and accelerometer systems as described herein by slightly spacing the deck portions away from the hub motor. In some examples, curved rails as described herein may improve slip resistance and comfort of a rider, as the curved rails may better support the foot of a rider.

In some examples, the bottom surface of each side rail may approximately replicate or mirror the shape of the top surface of the corresponding side rail, to give the entire side rail an overall concave-upward shape and provide additional ground clearance for the tip and tail of the vehicle. In other examples, the bottom surface of each side rail may be shaped either slightly or substantially differently from the top surface of the corresponding side rail.

D. Electrical Control System

Figure 11:
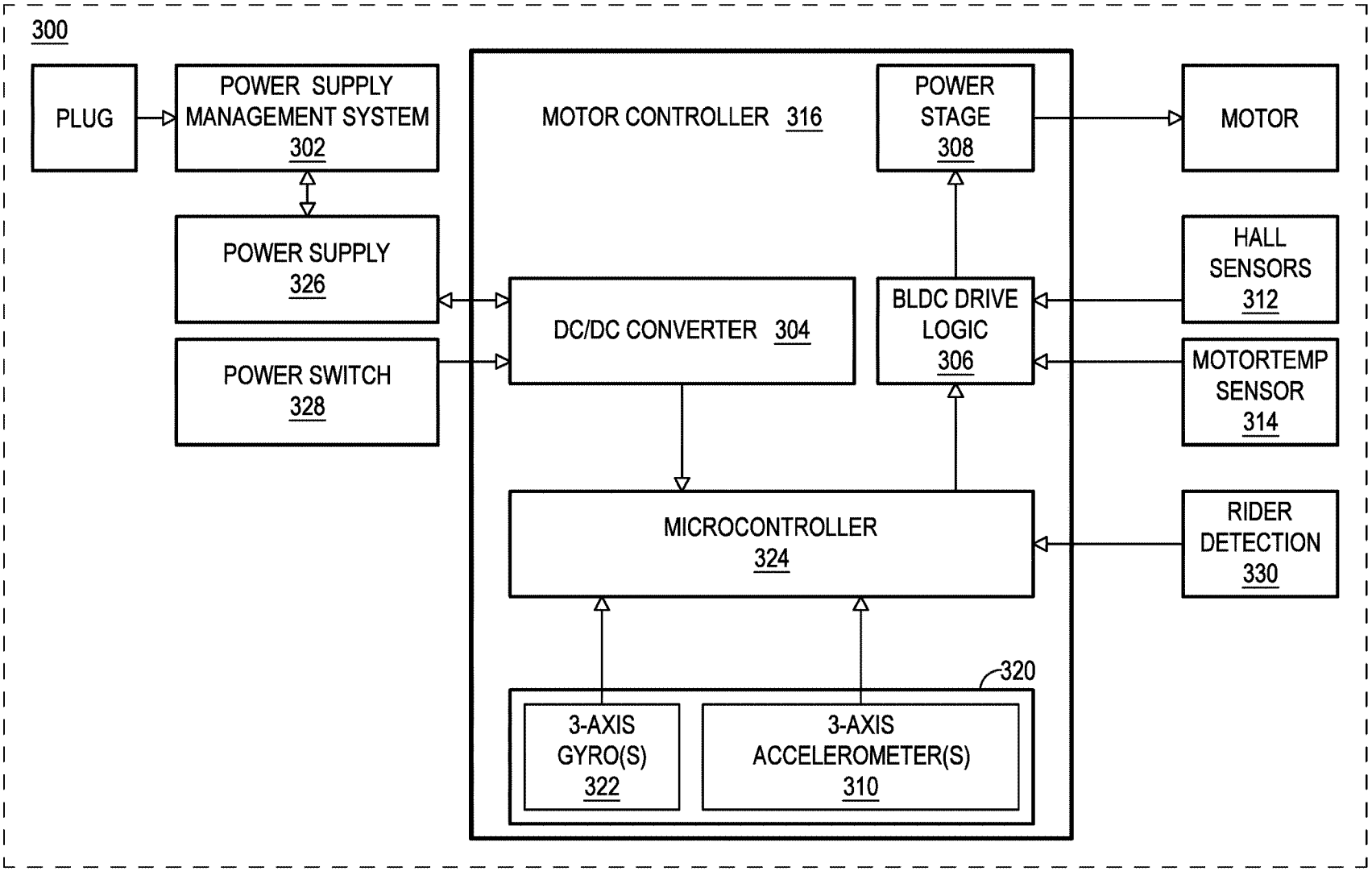
FIG. 11 is a schematic diagram depicting an illustrative electrical control system suitable for use with vehicles in accordance with aspects of the present disclosure.

FIG. 11 shows a block diagram of an electrical control system 300, an example of electrical control system 136 described briefly above, comprising various illustrative electrical components of vehicle 100. The electrical components may include a power supply management system 302, a direct current to direct current (DC/DC) converter 304, a brushless direct current (BLDC) drive logic 306, a power stage 308, one or more 2-axis accelerometers 310, one or more hall sensors 312, and/or a motor temperature sensor 314. DC/DC converter 304, BLDC drive logic 306, and power stage 308 may be included in and/or connected to a motor controller 316. Accelerometer(s) 310 may be included in the one or more orientation or tilt sensors 318 mentioned above.

Active balancing (or self-stabilization) of the electric vehicle may be achieved through the use of a feedback control loop or mechanism. The feedback control mechanism may include sensors 320, which may be electrically coupled to and/or included in motor controller 316. Preferably, the feedback control mechanism includes a Proportional-Integral-Derivative (PID) control scheme using one or more gyros 322 and one or more accelerometers (e.g., accelerometer(s) 310). Gyro 322 may be configured to measure a pivoting of the board about its pitch axis (also referred to as the fulcra) axis). Gyro 322 and accelerometer 310 may be collectively configured to estimate (or measure, or sense) a lean angle of the board, such as an orientation of the foot deck about the pitch, roll and/or yaw axes. In some embodiments, gyro 322 and accelerometer 310 may be collectively configured to sense orientation information sufficient to estimate the lean angle of the frame, including pivotation about the pitch, roll and/or yaw axes.

As mentioned above, orientation information of the board may be measured (or sensed) by gyro 322 and accelerometer 310. The respective measurements (or sense signals) from gyro 322 and accelerometer 310 may be combined using a complementary or Kalman filter to estimate a lean angle of the board (e.g., pivoting of the board about the pitch, roll, and/or yaw axes, with pivoting about the pitch axis corresponding to a pitch angle, pivoting about the roll axis corresponding to a roll or heel-toe angle, and pivoting about the yaw axis corresponding to a side-to-side yaw angle) while filtering out the impacts of bumps, road texture and disturbances due to steering inputs. For example, gyro 322 and accelerometer 310 may be connected to a microcontroller 324, which may be configured to correspondingly measure movement of the board about and along the pitch, roll, and/or yaw axes.

Alternatively, the electronic vehicle may include any suitable sensor and feedback control loop configured to self-stabilize a vehicle, such as a 1-axis gyro configured to measure pivotation of the board about the pitch axis, a 1-axis accelerometer configured to measure a gravity vector, and/or any other suitable feedback control loop, such as a closed-loop transfer function. Additional accelerometer and gyro axes may allow improved performance and functionality, such as detecting if the board has rolled over on its side or if the rider is making a turn.

The feedback control loop may be configured to drive the motor to reduce an angle of the board with respect to the ground. For example, if a rider were to angle the board downward, so that the first deck portion was 'lower' than the second deck portion (e.g., if the rider pivoted the board in a first rotational direction), then the feedback loop may drive the motor to cause rotation of tire about the pitch axis in the first rotational direction, thereby causing a force on the board in the second, opposing rotational direction.

Thus, motion of the electric vehicle may be achieved by the rider leaning his or her weight toward a selected (e.g., "front") foot. Similarly, deceleration may be achieved by the rider leaning toward the other (e.g., "back" foot). Regenerative braking can be used to slow the vehicle. Sustained operation may be achieved in either direction by the rider maintaining their lean toward either selected foot.

As indicated in FIG. 11, microcontroller 324 may be configured to send a signal to brushless DC (BLDC) drive logic 306, which may communicate information relating to the orientation and motion of the board. BLDC drive logic 306 may then interpret the signal and communicate with power stage 308 to drive the motor accordingly. Hall sensors 312 may send a signal to the BLDC drive logic to provide feedback regarding a substantially instantaneous rotational rate of the rotor of the motor. Motor temperature sensor 314 may be configured to measure a temperature of the motor and send this measured temperature to logic 306. Logic 306 may limit an amount of power supplied to the motor based on the measured temperature of the motor to prevent the motor from overheating.

Certain modifications to the PID loop or other suitable feedback control loop may be incorporated to improve performance and safety of the electric vehicle. For example, integral windup may be prevented by limiting a maximum integrator value, and an exponential function may be applied to a pitch error angle (e.g., a measure or estimated pitch angle of the board).

Alternatively or additionally, some embodiments may include neural network control, fuzzy control, genetic algorithm control, linear quadratic regulator control, state-dependent Riccati equation control, and/or other control algorithms. In some embodiments, absolute or relative encoders may be incorporated to provide feedback on motor position.

During turning, the pitch angle can be modulated by the heel-toe angle (e.g., pivoting of the board about the roll axis), which may improve performance and prevent a front inside edge of the board from touching the ground. In some embodiments, the feedback loop may be configured to increase, decrease, or otherwise modulate the rotational rate of the tire if the board is pivoted about the roll and/or yaw axes. This modulation of the rotational rate of the tire may exert an increased normal force between a portion of the board and the rider, and may provide the rider with a sense of "carving" when turning, similar to the feel of carving a snowboard through snow or a surfboard through water.

Once the rider has suitably positioned themselves on the board, the control loop may be configured to not activate until the rider moves the board to a predetermined orientation. For example, an algorithm may be incorporated into the feedback control loop, such that the control loop is not active (e.g., does not drive the motor) until the rider uses their weight to bring the board up to an approximately level orientation (e.g., 0 degree pitch angle). Once this predetermined orientation is detected, the feedback control loop may be enabled (or activated) to balance the electric vehicle and to facilitate a transition of the electric vehicle from a stationary mode (or configuration, or state, or orientation) to a moving mode (or configuration, or state, or orientation).

With continued reference to FIG. 11, the various electrical components may be configured to manage a power supply 326. For example, power supply management system 302 may be a battery management system configured to protect batteries of power supply 326 from being overcharged, over-discharged, and/or short-circuited. System 302 may monitor battery health, may monitor a state of charge in power supply 326, and/or may increase the safety of the vehicle. Power supply management system 302 may be connected between a charge plug of the vehicle and power supply 326. The rider (or other user) may couple a charger to the plug and re-charge power supply 326 via system 302.

In operation, power switch 328 may be activated (e.g., by the rider). Activation of switch 328 may send a power-on signal to converter 304. In response to the power-on signal, converter 304 may convert direct current from a first voltage level provided by power supply 326 to one or more other voltage levels. The other voltage levels may be different than the first voltage level. Converter 304 may be connected to the other electrical components via one or more electrical connections to provide these electrical components with suitable voltages.

Converter 304 (or other suitable circuitry) may transmit the power-on signal to microcontroller 324. In response to the power-on signal, microcontroller may initialize sensors 320, and a rider detection device 330.

The electric vehicle may include one or more safety mechanisms, such as power switch 328 and/or rider detection device 330 to ensure that the rider is on the board before engaging the feedback control loop. In some embodiments, rider detection device 330 may be configured to determine if the rider's feet are disposed on the foot deck, and to send a signal causing the motor to enter an active state when the rider's feet are determined to be disposed on the foot deck.

Rider detection device 330 may include any suitable mechanism, structure, or apparatus for determining whether the rider is on the electric vehicle. For example, device 330 may include one or more mechanical buttons, one or more capacitive sensors, one or more inductive sensors, one or more optical switches, one or more force resistive sensors, and/or one or more strain gauges. Rider detection device 330 may be located on or under either or both of the first and second deck portions. In some examples, the one or more mechanical buttons or other devices may be pressed directly (e.g., if on the deck portions), or indirectly (e.g., if under the deck portions), to sense whether the rider is on the board.

In some examples, the one or more capacitive sensors and/or the one or more inductive sensors may be located on or near a surface of either or both of the deck portions, and may correspondingly detect whether the rider is on the board via a change in capacitance or a change in inductance. In some examples, the one or more optical switches may be located on or near the surface of either or both of the deck portions. The one or more optical switches may detect whether the rider is on the board based on an optical signal. In some examples, the one or more strain gauges may be configured to measure board or axle flex imparted by the rider's feet to detect whether the rider is on the board. In some embodiments, rider detection device 330 may include a hand-held "dead-man" switch.

If device 330 detects that the rider is suitably positioned on the electric vehicle, then device 330 may send a rider-present signal to microcontroller 324. The rider-present signal may be the signal causing the motor to enter the active state. In response to the rider-present signal (and/or, for example, the board being moved to the level orientation), microcontroller 324 may activate the feedback control loop for driving the motor. For example, in response to the rider-present signal, microcontroller 324 may send board orientation information (or measurement data) from sensors 320 to logic 306 for powering the motor via power stage 308.

In some embodiments, if device 338 detects that the rider is no longer suitably positioned or present on the electric vehicle, device 338 may send a rider-not-present signal to microcontroller 324. In response to the rider-not-present signal, circuitry of the vehicle (e.g., microcontroller 324, logic 306, and/or power stage 308) may be configured to reduce a rotational rate of the rotor relative to the stator to bring the vehicle to a stop. For example, the electric coils of the rotor may be selectively powered to reduce the rotational rate of the rotor. In some embodiments, in response to the rider-not-present signal, the circuitry may be configured to energize the electric coils with a relatively strong and/or substantially continuously constant voltage, to lock the rotor relative to the stator, to prevent the rotor from rotating relative to the stator, and/or to bring the rotor to a sudden stop.

In some embodiments, the vehicle may be configured to actively drive the motor even though the rider may not be present on the vehicle (e.g., temporarily), which may allow the rider to perform various tricks. For example, rider detection device 330 may be configured to delay sending the rider-not-present signal to the microcontroller for a predetermined duration of time, and/or the microcontroller may be configured to delay sending the signal to logic 306 to cut power to the motor for a predetermined duration of time.

E. Illustrative Combinations and Additional Examples

This section describes additional aspects and features of concave side rails for one-wheeled vehicles, presented without limitation as a series of paragraphs, some or all of which may be alphanumerically designated for clarity and efficiency. Each of these paragraphs can be combined with one or more other paragraphs, and/or with disclosure from elsewhere in this application, including the materials incorporated by reference in the Cross-References, in any suitable manner. Some of the paragraphs below expressly refer to and further limit other paragraphs, providing without limitation examples of some of the suitable combinations.

A0. An electric vehicle, comprising:

a board including first and second deck portions each configured to receive a left or right foot of a rider oriented generally perpendicular to a direction of travel of the board;

a wheel assembly including a rotatable ground-contacting element disposed between and extending above the first and second deck portions;

a motor assembly mounted to the board and configured to rotate the ground-contacting element around an axle to propel the electric vehicle;

at least one sensor configured to measure orientation information of the board;

a motor controller configured to receive orientation information measured by the sensor and to cause the motor assembly to propel the electric vehicle based on the orientation information; and a pair of side rails respectively disposed on each lateral side of the board, each side rail including a first end portion connected to the first deck portion, a second end portion connected to the second deck portion, and a central portion disposed between the first end portion and the second end portion;

wherein a top surface of each side rail defines a generally concave shape such that a plane connecting distal edges of the end portions of the side rail is spaced apart from the central portion of the side rail.

A1. The electric vehicle of paragraph A0, wherein the top surface of each side rail is continually curved between the distal edges of the end portions of the side rail.

A2. The electric vehicle of paragraph A0, wherein the top surface of each side rail includes a plurality of linear segments that collectively define the generally concave shape.

A3. The electric vehicle of paragraph A0, wherein the top surface of each side rail includes three linear segments that collectively define the generally concave shape.

A4. The electric vehicle of paragraph A0, wherein the top surface of each side rail includes three segments of differing curvature that collectively define the generally concave shape.

A5. The electric vehicle of any of paragraphs A0 through A4, wherein a bottom surface of each side rail includes a central concave camber cutout.

A6. The electric vehicle of any of paragraphs A0 through A5, further comprising a suspension system coupling the wheel assembly to the board and configured to allow the wheel assembly to move up and down with respect to the deck portions.

A7. The electric vehicle of any of paragraphs A0 through A6, wherein a bottom surface of each side rail has a generally concave-upward shape, to provide the first and second end portions of the side rails with relatively greater ground clearance.

B0. An electric vehicle, comprising:

a board including first and second deck portions each configured to receive a left or right foot of a rider oriented generally perpendicular to a direction of travel of the board;

a wheel disposed between and extending above the first and second deck portions;

a hub motor configured to rotate the wheel around an axle to propel the electric vehicle;

a motor controller configured to cause the hub motor to propel the electric vehicle based on an orientation of the board; and a stabilizing side rail respectively disposed on each lateral side of the board, each side rail including a first end portion connected to the first deck portion and including a first distal edge, a second end portion connected to the second deck portion and including a second distal edge, and a central portion between the end portions;

wherein a top surface of each side rail defines a generally concave shape such that a plane connecting distal edges of the side rail is spaced apart from the central portion of the side rail.

B1. The electric vehicle of paragraph B0, wherein the top surface of each side rail is continually curved between the distal edges of the side rail.

B2. The electric vehicle of paragraph B0, wherein the top surface of each side rail includes a plurality of linear segments that collectively define the generally concave shape.

B3. The electric vehicle of paragraph B0, wherein the top surface of each side rail includes a plurality of segments of differing curvature that collectively define the generally concave shape.

B4. The electric vehicle of any of paragraphs B0 through B3, wherein a bottom surface of each side rail includes a central cutout.

B5. The electric vehicle of any of paragraphs B0 through B4, further comprising a suspension system coupling the wheel to the board and configured to allow the wheel to move up and down with respect to the deck portions.

B6. The electric vehicle of any of paragraphs B0 through B5, wherein a bottom surface of each side rail has a generally concave-upward shape, to provide the deck portions with relatively greater ground clearance.

C0. An electric vehicle, comprising:

a board including first and second deck portions;

a wheel disposed between and extending above the first and second deck portions;

a hub motor configured to rotate the wheel;

one or more sensors configured to determine an orientation of the board;

a motor controller configured to cause the hub motor to rotate based on the orientation of the board; and a side rail attached to each lateral side of the board, each side rail including a first end portion connected to the first deck portion, a second end portion connected to the second deck portion, and a central portion between the end portions;

wherein a top surface of each side rail defines a generally concave shape such that a plane tangent to the end portions of the side rail is spaced apart from a top surface of the central portion of the side rail.

C1. The electric vehicle of paragraph C0, wherein the top surface of each side rail is continually curved between distal edges of the side rail.

C2. The electric vehicle of paragraph C0, wherein the top surface of each side rail includes a plurality of linear segments.

C3. The electric vehicle of paragraph C0, wherein the top surface of each side rail includes three linear segments that collectively define the generally concave shape.

C4. The electric vehicle of paragraph C0, wherein the top surface of each side rail includes a plurality of segments of differing curvature that collectively define the generally concave shape.

C5. The electric vehicle of any of paragraphs C0 through C4, wherein a bottom surface of each side rail includes a central cutout.

C6. The electric vehicle of any of paragraphs C0 through C5, further comprising a suspension system coupling the wheel to the board and configured to allow the wheel to move with respect to the board.

C7. The electric vehicle of any of paragraphs C0 through C6, wherein a bottom surface of each side rail has a generally concave-upward shape, to provide tip and tail portions of the board with increased ground clearance.

Advantages, Features, and Benefits

The different embodiments and examples of the concave rails for one-wheeled vehicles described herein provide several advantages over known rails for one-wheeled vehicles. For example, illustrative embodiments and examples described herein allow access to connecting features coupling a suspension system to an axle, facilitating tuning and maintenance of the suspension system.

Additionally, and among other benefits, illustrative embodiments and examples described herein provide increased tip and tail clearance as the board tilts during use, and as the board moves up and down with respect to the wheel due to the suspension system.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

The invention claimed is:

1. An electric vehicle, comprising:

a board including first and second deck portions each configured to receive a left or right foot of a rider oriented generally perpendicular to a direction of travel of the board;

a wheel assembly including a rotatable ground-contacting element disposed between and extending above the first and second deck portions;

a motor assembly mounted to the board and configured to rotate the ground-contacting element around an axle to propel the electric vehicle;

at least one sensor configured to measure orientation information of the board;

a motor controller configured to receive orientation information measured by the sensor and to cause the motor assembly to propel the electric vehicle based on the orientation information; and a pair of side rails respectively disposed on each lateral side of the board, each side rail including a first end portion connected to the first deck portion, a second end portion connected to the second deck portion, and a central portion disposed between the first end portion and the second end portion;

wherein a top surface of each side rail defines a generally concave shape such that a plane connecting distal edges of the end portions of the side rail is spaced apart from the central portion of the side rail.

2. The electric vehicle of claim 1, wherein the top surface of each side rail is continually curved between the distal edges of the end portions of the side rail.

3. The electric vehicle of claim 1, wherein the top surface of each side rail includes a plurality of linear segments that collectively define the generally concave shape.

4. The electric vehicle of claim 1, wherein the top surface of each side rail includes three linear segments that collectively define the generally concave shape.

5. The electric vehicle of claim 1, wherein a bottom surface of each side rail has a generally concave-upward shape, to provide the first and second end portions of the side rails with relatively greater ground clearance.

6. The electric vehicle of claim 1, wherein a bottom surface of each side rail includes a central concave camber cutout.

7. The electric vehicle of claim 1, further comprising a suspension system coupling the wheel assembly to the board and configured to allow the wheel assembly to move up and down with respect to the deck portions.

8. An electric vehicle, comprising:

a board including first and second deck portions each configured to receive a left or right foot of a rider oriented generally perpendicular to a direction of travel of the board;

a wheel disposed between and extending above the first and second deck portions;

a hub motor configured to rotate the wheel around an axle to propel the electric vehicle;

a motor controller configured to cause the hub motor to propel the electric vehicle based on an orientation of the board; and a stabilizing side rail respectively disposed on each lateral side of the board, each side rail including a first end portion connected to the first deck portion and including a first distal edge, a second end portion connected to the second deck portion and including a second distal edge, and a central portion between the end portions;

wherein a top surface of each side rail defines a generally concave shape such that a plane connecting distal edges of the side rail is spaced apart from the central portion of the side rail.

9. The electric vehicle of claim 8, wherein the top surface of each side rail is continually curved between the distal edges of the side rail.

10. The electric vehicle of claim 8, wherein the top surface of each side rail includes a plurality of linear segments that collectively define the generally concave shape.

11. The electric vehicle of claim 8, wherein a bottom surface of each side rail has a generally concave-upward shape, to provide the deck portions with relatively greater ground clearance.

12. The electric vehicle of claim 8, wherein a bottom surface of each side rail includes a central cutout.

13. The electric vehicle of claim 8, further comprising a suspension system coupling the wheel to the board and configured to allow the wheel to move up and down with respect to the deck portions.

14. An electric vehicle, comprising:

a board including first and second deck portions;

a wheel disposed between and extending above the first and second deck portions;

a hub motor configured to rotate the wheel;

one or more sensors configured to determine an orientation of the board;

a motor controller configured to cause the hub motor to rotate based on the orientation of the board; and a side rail attached to each lateral side of the board, each side rail including a first end portion connected to the first deck portion, a second end portion connected to the second deck portion, and a central portion between the end portions;

wherein a top surface of each side rail defines a generally concave shape such that a plane tangent to the end portions of the side rail is spaced apart from a top surface of the central portion of the side rail.

15. The electric vehicle of claim 14, wherein the top surface of each side rail is continually curved between distal edges of the side rail.

16. The electric vehicle of claim 14, wherein the top surface of each side rail includes a plurality of linear segments.

17. The electric vehicle of claim 14, wherein the top surface of each side rail includes three linear segments that collectively define the generally concave shape.

18. The electric vehicle of claim 14, wherein a bottom surface of each side rail has a generally concave-upward shape, to provide tip and tail portions of the board with increased ground clearance.

19. The electric vehicle of claim 14, wherein a bottom surface of each side rail includes a central cutout.

20. The electric vehicle of claim 14, further comprising a suspension system coupling the wheel to the board and configured to allow the wheel to move with respect to the board.

* * * * *